US008002259B2

(12) United States Patent
Kishimoto et al.

(10) Patent No.: US 8,002,259 B2
(45) Date of Patent: Aug. 23, 2011

(54) IMAGE FORMING APPARATUS, METHOD FOR ASSISTING PAPER SHEET SUPPLYING OPERATION AND CONTROL PROGRAM OF THE SAME

(75) Inventors: Kazuhisa Kishimoto, Mitaka (JP); Toshihisa Yamanaka, Hachioji (JP); Yukihiko Ichikawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 45 days.

(21) Appl. No.: 12/551,188

(22) Filed: Aug. 31, 2009

(65) Prior Publication Data

US 2010/0052243 A1 Mar. 4, 2010

(30) Foreign Application Priority Data

Sep. 3, 2008 (JP) ..... 2008-225882

(51) Int. Cl.
*B65H 3/44* (2006.01)
*B65H 5/26* (2006.01)

(52) U.S. Cl. ..... 271/9.01; 271/9.03; 271/9.05; 271/9.06; 399/391

(58) Field of Classification Search ..... 271/9.01, 271/9.03, 9.05, 9.06; 399/391
See application file for complete search history.

(56) References Cited

U.S. PATENT DOCUMENTS

| | | | | |
|---|---|---|---|---|
| 7,177,554 | B2 * | 2/2007 | Van Vliembergen | 399/23 |
| 2008/0258374 | A1 * | 10/2008 | Inoue | 271/9.03 |
| 2009/0315249 | A1 * | 12/2009 | Yamanaka et al. | 271/9.01 |
| 2010/0117289 | A1 * | 5/2010 | Takahashi et al. | 271/9.01 |

FOREIGN PATENT DOCUMENTS

| | | |
|---|---|---|
| JP | 2005-014361 | 1/2005 |
| JP | 2005-30657 | 2/2005 |
| JP | 2007-210784 | 8/2007 |

OTHER PUBLICATIONS

Japanese Office Action dated Jun. 25, 2010.
Japanese Office Action corresponding to Japanese Patent Application No. 2008-225882 dated Oct. 8, 2010.

* cited by examiner

*Primary Examiner* — Kaitlin S Joerger
*Assistant Examiner* — Prasad V Gokhale
(74) *Attorney, Agent, or Firm* — Finnegan, Henderson, Farabow, Garrett & Dunner, L.L.P.

(57) ABSTRACT

Described is an image forming apparatus, which makes it possible to create a vacant tray. The apparatus includes a paper sheet managing section to conduct consecutive operations including: acquiring the residual amount of the paper sheets accommodated in each of plurality paper sheet trays; calculating a total sum of residual amounts of paper sheets having the same attributes; comparing the above-calculated total sum with the maximum accommodating capacity of each of the paper sheet trays currently accommodating the paper sheets concerned; and notifying the operator of the fact that a vacant tray can be made by collecting the paper sheets concerned into a specific paper sheet tray, if there exists such paper sheets and a combination of paper sheet trays that make the total sum of the residual amounts of the paper sheets equal to or smaller than the maximum accommodating capacity of the specific paper sheet tray.

15 Claims, 8 Drawing Sheets

40: PAPER-SHEET SUPPLY ASSISTING SCREEN

40: PAPER-SHEET SUPPLY ASSISTING SCREEN

IMAGE FORMING APPARATUS, METHOD FOR ASSISTING PAPER SHEET SUPPLYING OPERATION AND CONTROL PROGRAM OF THE SAME

This application is based on Japanese Patent Application NO. 2008-225882 filed on Sep. 3, 2008, with the Japan Patent Office, the entire content of which is hereby incorporated by reference.

BACKGROUND OF THE INVENTION

The present invention relates to an image forming apparatus, a method for assisting a paper sheet supplying operation and a control program, and specifically relates to an image forming apparatus, a method for assisting a paper sheet supplying operation and a control program, each of which makes a vacant tray so as to make it possible to supply paper sheets in a unit of a single or a plurality of bunches of paper sheets.

In recent years, there have been increasingly proliferated in the market various kinds of printing apparatuses, such as a printer, a Digital Multi Function Peripheral, etc., (hereinafter, referred to as an image forming apparatus as a general term for each of them). Since the image forming apparatus conducts such processing for forming an image based on a print job, and then, transferring the concerned image onto a paper sheet accommodated in a paper sheet tray, the print job concerned is suspended when the paper sheet tray becomes empty. Accordingly, from the apparatus operating point of view, it has been important for an operator of the image forming apparatus to conduct such management activities for purchasing, storing, supplying the paper sheets, etc.

With respect to the management operation of the paper sheets, generally well-known is a technology for detecting a residual amount of paper sheets remaining in the paper sheet tray, so as to notify the operator of the necessity of the paper sheet supplying operation when the residual amount of paper sheets decreases to a value being equal to or smaller than a certain threshold value. For instance, the publication of Japanese Patent Application Laid-Open No. 2005-30657 sets forth a method for displaying information of another paper sheet tray, for which the same size and the same kind of paper sheets are established, in an emphasized mode, when the residual amount of paper sheets remaining in the paper sheet tray currently used decreases.

In this connection, the paper sheets to be used in the image forming apparatus are purchased in such a state that a single or plural bunches of paper sheets, each of which includes several hundred paper sheets, is/are packaged into a single box. When the box is opened and a part of a single bunch of paper sheets are supplied into the paper sheet tray, usually, the remaining paper sheets have been piled onto a shelf in a careless way, to store them. In this case, there have arisen such problems that the paper sheets are contaminated and bended to such an extent that those cannot be employed for actual use, and the environmental beauty is spoiled.

In order to eliminate the abovementioned problems, it would be desirable that the paper sheets are supplied into the apparatus in a unit of a single bunch of paper sheets or a plurality of bunches of paper sheets (for instance, a unit of one box). Generally speaking, however, since a capacity of the paper sheet tray is set at such a size that a single bunch of paper sheets or a plurality of bunches of paper sheets can be just accommodated therein, if the paper sheets are newly supplied into the paper sheet tray in which a certain amount of paper sheets still remain, it is impossible to accommodate a part of the paper sheets therein. As a result, it becomes impossible to eliminate the abovementioned problems.

According to the conventional technology as described in the above, when considering from the apparatus operation point of view, it is possible to avoid the suspension of print job caused by the shortage of the paper sheets, while, when considering from the supplier's point of view, it becomes necessary to conduct management activities for handling paper sheets remaining after the paper sheet supplying operation has been completed. Further, there arisen such problems that contaminations and bended folds, generated in the paper sheets, cause losses in its running cost and resources due to unavailability of them, and the environmental beauty around the paper sheet storing place is spoiled.

Further, with respect to a kind of paper sheet, a used amount of which is relatively large, for instance, with respect to the A4 vertical-type paper sheets, it is widely and practically implemented to allot this kind of paper sheets to a plurality of paper sheet trays. However, even in such a case that specific kind of paper sheets are accommodated in each of the plurality of paper sheet trays, for instance, up to a half of its accommodating capacity, the paper sheets occupies plural paper sheet trays. Accordingly, even when the operator wishes to temporarily allot a separate kind of paper sheets to any one of the plural paper sheet trays, it is impossible to achieve this unless a vacant tray exists.

SUMMARY OF THE INVENTION

To overcome the abovementioned drawbacks in conventional image forming apparatuses, it is one of objects of the present invention to provide an image forming apparatus, a method for assisting a paper sheet supplying operation and a control program, each of which makes it possible to create a vacant tray. Further, it is another one of objects of the present invention to provide an image forming apparatus, a method for assisting a paper sheet supplying operation and a control program, each of which makes it possible to supply paper sheets in a unit of a single or a plurality of bunches of paper sheets, by creating a vacant tray.

Accordingly, at least one of the objects of the present invention can be attained by any one of the image forming apparatuses, the method for assisting a paper sheet supplying operation and the computer readable storage medium described as follows.

(1) According to an image forming apparatus reflecting an aspect of the present invention, the image forming apparatus comprises: a plurality of paper sheet trays to accommodate a plurality of paper sheets, onto each of which a formed image is to be transferred, therein; a plurality of detecting sections, each of which is provided in each of the plurality of paper sheet trays and detects a residual amount of the plurality of paper sheets accommodated in each of the plurality of the paper sheet trays; and a paper sheet managing section to conduct consecutive operations including: acquiring the residual amount of the paper sheets accommodated in each of the plurality of the paper sheet trays from each of the plurality of the detecting sections; calculating a total sum of residual amounts of paper sheets having same attributes and included in the plurality of paper sheets; comparing the total sum of the residual amounts of the paper sheets with a maximum accommodating capacity of each of paper sheet trays currently accommodating the paper sheets having the same attributes; and notifying an operator of a fact that a vacant tray can be made by collecting the paper sheets, having the same attributes and currently accommodated in the paper sheet trays, into a specific paper sheet tray, if there exists such paper sheets and a combination of paper sheet trays that make the total sum of the residual amount of the paper sheets equal to or smaller than the maximum accommodating capacity of the specific paper sheet tray.

(2) According to another aspect of the present invention, in the image forming apparatus recited in item 1, the paper sheet managing section calculates the total sum of residual amounts of paper sheets, which are same in size, kind and direction; and the paper sheet managing section compares the total sum of the residual amounts of the paper sheets with the maximum accommodating capacity of each of paper sheet trays included in a group currently accommodating the paper sheets; and if there exists such paper sheets and a combination of paper sheet trays that make the total sum of the residual amount of the paper sheets equal to or smaller than the maximum accommodating capacity of a predetermined paper sheet tray included in the group, the paper sheet managing section notifies the operator of a fact that, by collecting the paper sheets into the predetermined paper sheet tray, other paper sheet trays included in the group become empty.

(3) According to still another aspect of the present invention, in the image forming apparatus recited in item 2, when there exist plural combinations of paper sheet trays, each of which makes the total sum of the residual amount of the paper sheets equal to or smaller than the maximum accommodating capacity, the paper sheet managing section notifies the operator of a combination of paper sheet trays for collecting the paper sheets into a paper sheet tray whose maximum accommodating capacity is a greatest, a combination of paper sheet trays for shifting the paper sheets whose capacity is smallest into the predetermined paper sheet tray, or a combination of paper sheet trays for making a number of paper sheet trays included in the group smallest, in preference to other combinations of paper sheet trays included in the plural combinations of paper sheet trays.

(4) According to still another aspect of the present invention, in the image forming apparatus recited in item 1, the paper sheet managing section calculates the total sum of residual amounts of paper sheets, which are same in size and kind; and the paper sheet managing section compares the total sum of the residual amounts of the paper sheets with the maximum accommodating capacity of each of paper sheet trays included in a group currently accommodating the paper sheets; and if there exists such paper sheets and a combination of paper sheet trays that make the total sum of the residual amount of the paper sheets equal to or smaller than the maximum accommodating capacity of a predetermined paper sheet tray included in the group, the paper sheet managing section discriminates a direction of paper sheets accommodated in each of the paper sheet trays included in the group, and when directions of paper sheets are different from each other, notifies the operator of a fact that, by collecting the paper sheets into the predetermined paper sheet tray while adjusting the directions of paper sheets at a same direction, other paper sheet trays included in the group become empty.

(5) According to still another aspect of the present invention, in the image forming apparatus recited in item 4, when there exist plural combinations of paper sheet trays, each of which makes the total sum of the residual amount of the paper sheets equal to or smaller than the maximum accommodating capacity, the paper sheet managing section notifies the operator of a combination of paper sheet trays for collecting the paper sheets into a paper sheet tray whose maximum accommodating capacity is a greatest, a combination of paper sheet trays for shifting the paper sheets whose capacity is smallest into the predetermined paper sheet tray, or a combination of paper sheet trays for making a number of paper sheet trays included in the group smallest, in preference to other combinations of paper sheet trays included in the plural combinations of paper sheet trays.

(6) According to a method reflecting still another aspect of the present invention, the method for assisting a paper sheet supplying operation, which is to be employed in an image forming apparatus that includes a plurality of paper sheet trays to accommodate a plurality of paper sheets, onto each of which a formed image is to be transferred, therein, and a plurality of detecting sections, each of which is provided in each of the plurality of paper sheet trays and detects a residual amount of the plurality of paper sheets accommodated in each of the plurality of the paper sheet trays, comprises: storing attributes of the plurality of paper sheets accommodated in each of the plurality of the paper sheet trays; acquiring the residual amount of the paper sheets accommodated in each of the plurality of the paper sheet trays from each of the plurality of the detecting sections; calculating a total sum of residual amounts of paper sheets having same attributes and included in the plurality of paper sheets, so as to store the total sum; comparing the total sum of the residual amounts of the paper sheets with a maximum accommodating capacity of each of paper sheet trays currently accommodating the paper sheets having the same attributes; notifying an operator of a fact that a vacant tray can be made by collecting the paper sheets, having the same attributes and currently accommodated in the paper sheet trays, into a specific paper sheet tray, if there exists such paper sheets and a combination of paper sheet trays that makes the total sum of the residual amount of the paper sheets equal to or smaller than the maximum accommodating capacity of the specific paper sheet tray.

(7) According to a computer readable storage medium reflecting yet another aspect of the present invention, the computer readable storage medium stores a computer executable program for assisting a paper sheet supplying operation to be implemented in an image forming apparatus, which includes: a plurality of paper sheet trays to accommodate a plurality of paper sheets, onto each of which a formed image is to be transferred, therein; and a plurality of detecting sections, each of which is provided in each of the plurality of paper sheet trays and detects a residual amount of the plurality of paper sheets accommodated in each of the plurality of the paper sheet trays, the program being executable by a computer to cause the computer to perform a process comprising: acquiring the residual amount of the paper sheets accommodated in each of the plurality of the paper sheet trays from each of the plurality of the detecting sections; calculating a total sum of residual amounts of paper sheets having same attributes and included in the plurality of paper sheets; comparing the total sum of the residual amounts of the paper sheets with a maximum accommodating capacity of each of paper sheet trays currently accommodating the paper sheets having the same attributes; notifying an operator of a fact that a vacant tray can be made by collecting the paper sheets, having the same attributes and currently accommodated in the paper sheet trays, into a specific paper sheet tray, if there exists such paper sheets and a combination of paper sheet trays that makes the total sum of the residual amount of the paper sheets equal to or smaller than the maximum accommodating capacity of the specific paper sheet tray.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5*a* shows a schematic diagram indicating an exemplary structure of a paper sheet supplying section provided in an image forming apparatus embodied in the present invention as EMBODIMENT 1, while

DETAILED DESCRIPTION OF THE PREFERRED EMBODIMENT

Figure 1:
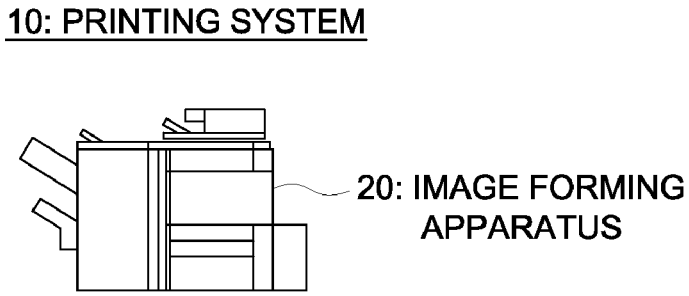
FIG. 1 shows a schematic diagram indicating a configuration of a printing system embodied in the present invention as EMBODIMENT 1.

As indicated in the "BACKGROUND OF THE INVENTION", when paper sheets are supplied into the paper sheet tray of the image forming apparatus, an operation for supplying paper sheets is conducted according to the warning message, such as a message of "NEAR EMPTY", etc., so as not to suspend the print job currently implemented. However, at the stage of "NEAR EMPTY", since a several number of paper sheets still remain in the paper sheet tray and, generally speaking, a maximum capacity of the paper sheet tray is set at a value same as that of a single bunch or a plurality of bunches of paper sheets, the several number of paper sheets cannot be supplied but remain as residual paper sheets. Accordingly, there arisen such problems that the residual paper sheets are damaged during the storing term and/or are scattered around the paper sheet storing place to such a extent that the environmental beauty around the paper sheet storing place is spoiled.

Further, with respect to a kind of paper sheets, the used amount of which is relatively great, for instance, the A4 vertical-type paper sheet, a plurality of paper sheet trays are allotted to such the kind of paper sheet in the most of the practical applications. However, even when the specific kind paper sheets are accommodated in each of the plurality of paper sheet trays, for instance, up to a half capacity of each of them, the plurality of paper sheet trays are occupied. Therefore, there arisen another problem that, even when the operator wishes to temporarily allot the paper sheet tray to a different kind of paper sheets, it is impossible for the operator to achieve the above, as far as a vacant tray does not exist.

To overcome the abovementioned drawbacks, the image forming apparatus, embodied in the present invention, employs the method including: detecting the residual amount of the paper sheets accommodated in a concerned paper sheet tray by using a capacity detecting section provided in each of the paper sheet trays; specifying the paper sheets having the same attribute; calculating a total sum of the residual amount of the paper sheets concerned; comparing the calculated total sum of the residual amount of the paper sheets with the maximum accommodating capacity of the paper sheet tray currently accommodating the paper sheets concerned; and if a combination, in which the total sum of the residual amount of the paper sheets concerned is equal to or smaller than the maximum accommodating capacity of the paper sheet tray, exists, notifying the operator of a paper sheet supplying recommendation indicating how to make a vacant tray by collecting the same attribute paper sheets into a specific paper sheet tray.

According to the above, the paper-sheet supplying operator can recognize that a vacant tray can be made by conducting an operation for shifting the paper sheets between the paper sheet trays concerned, according to the paper sheet supplying recommendation notified. Accordingly, it becomes possible for the operator to supply a desired unit of paper sheets into the vacant tray without leaving anything. Further, since it becomes unnecessary for the operator to store the paper sheets in a state that the package of them are opened, it becomes possible not only to solve the aforementioned problems in regard to the damages of the paper sheets and the environmental beauty, but also to eliminate the man-hours for securing the paper sheet storing place and moving the paper sheet, remaining after the paper sheet supplying operation is completed, to the paper sheet storing place. Still further, since it is possible to make the vacant tray, it also becomes possible to temporarily supply the different kind of paper sheets to this vacant tray.

Embodiment 1

Figure 2:
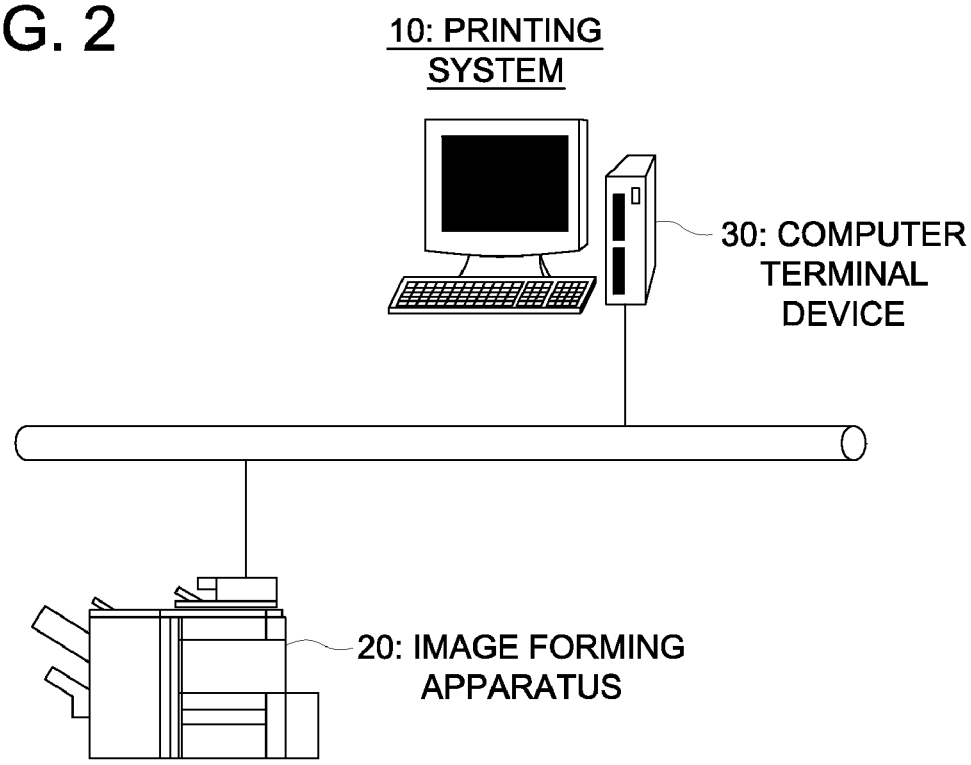
FIG. 2 shows a schematic diagram indicating another configuration of a printing system embodied in the present invention as EMBODIMENT 1.
Figure 3:
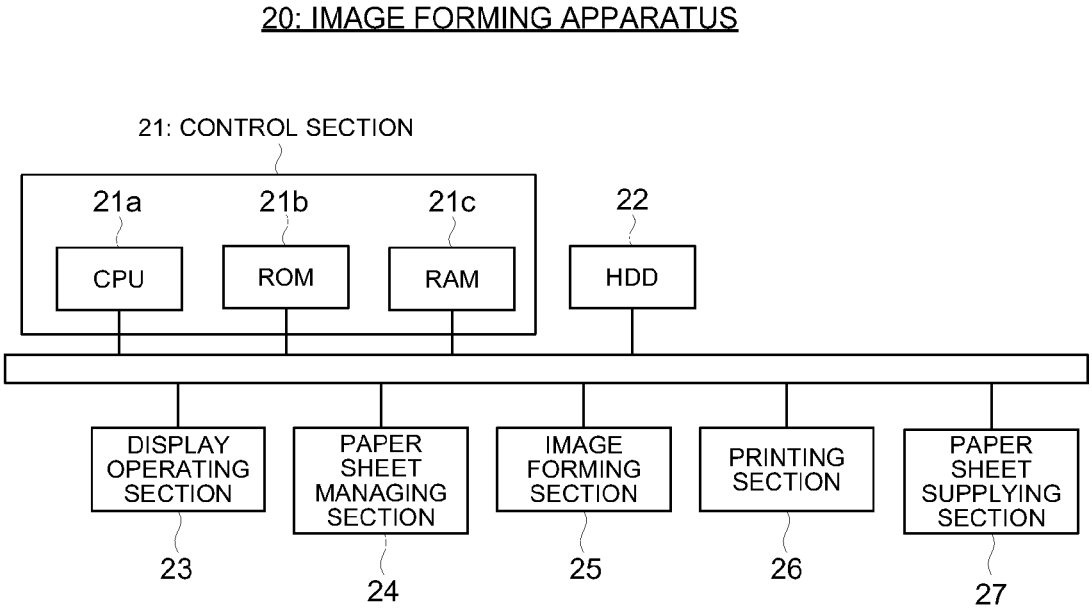
FIG. 3 shows a block diagram indicating a configuration of an image forming apparatus embodied in the present invention as EMBODIMENT 1.
Figure 4:
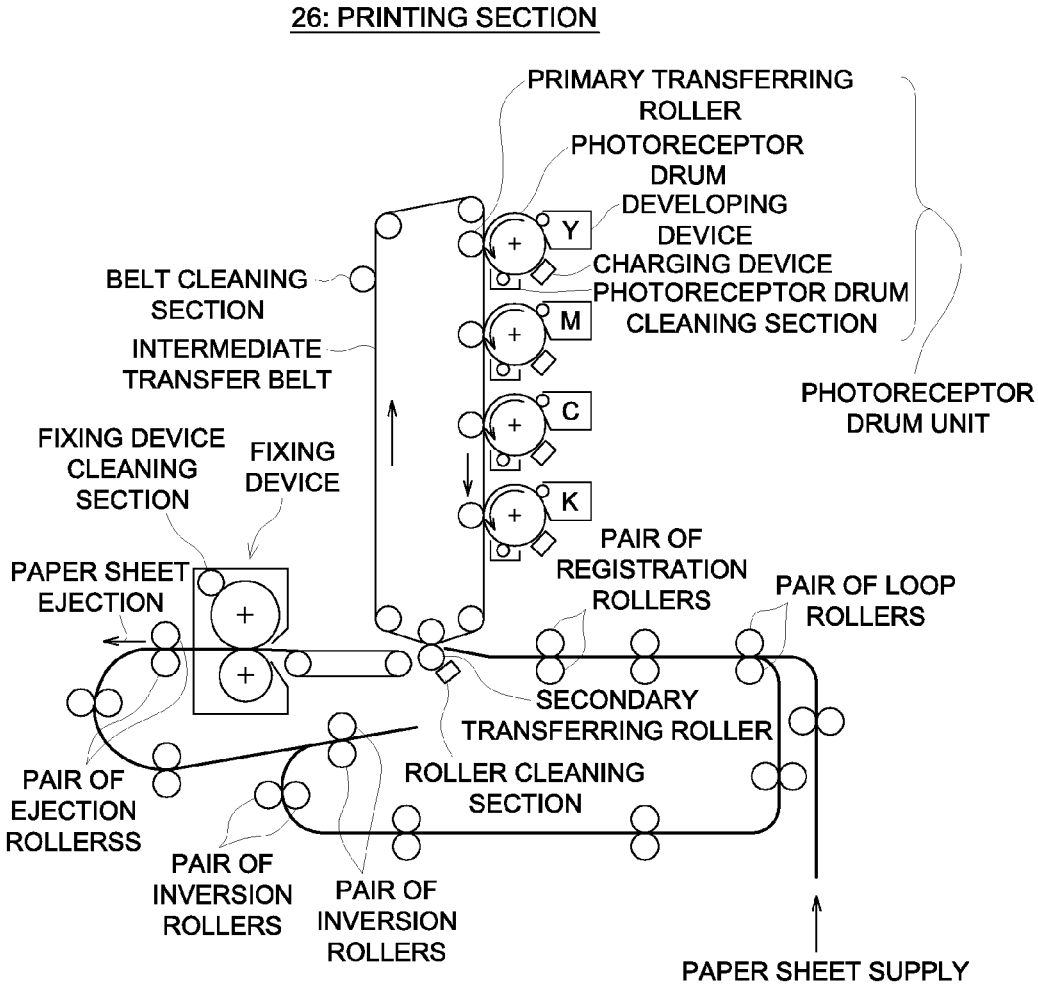
FIG. 4 shows a schematic diagram indicating an exemplary structure of a printing section provided in an image forming apparatus embodied in the present invention as EMBODIMENT 1.
Figure 5A:
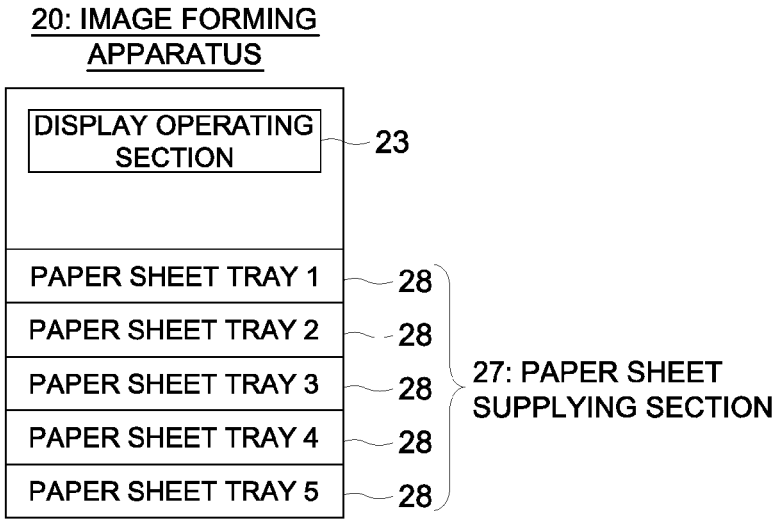
Figure 5B:
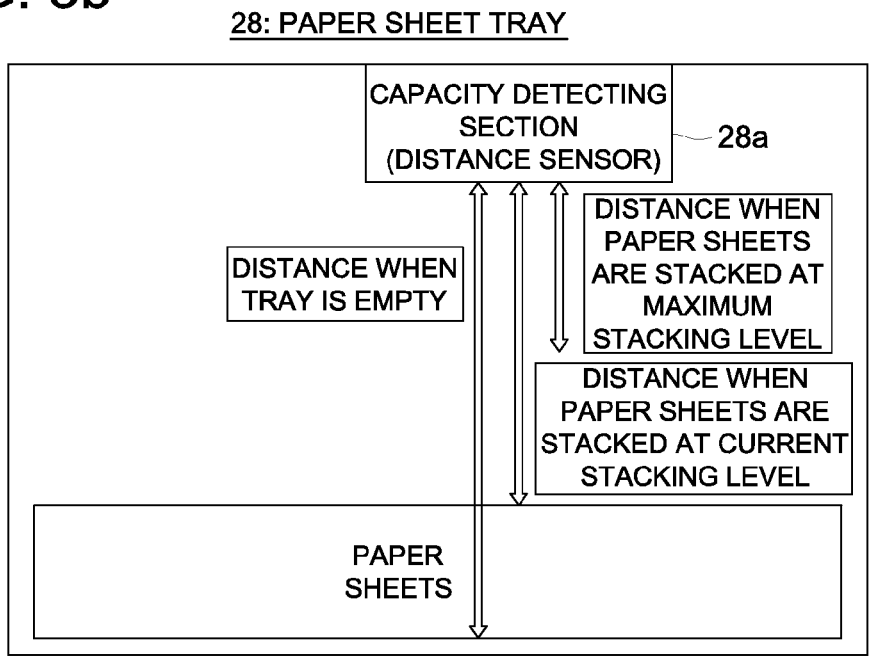
FIG. 5*b* shows a schematic diagram indicating an exemplary structure of a paper sheet accommodating capacity detecting section provided in a paper sheet tray.
Figure 6:
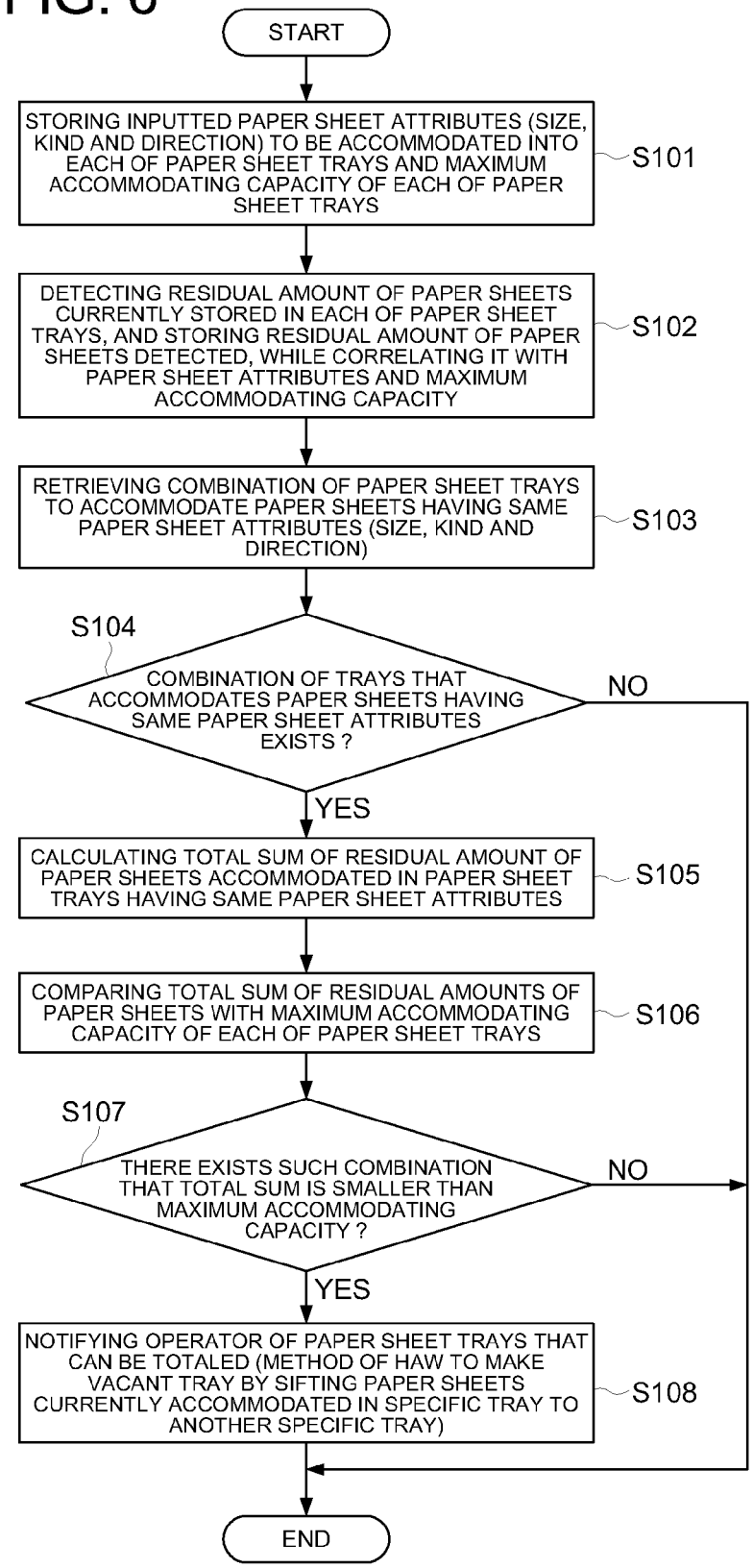
FIG. 6 shows a flowchart indicating a method for assisting paper sheet supplying operation to be conducted in an image forming apparatus embodied in the present invention as EMBODIMENT 1.
Figure 7:
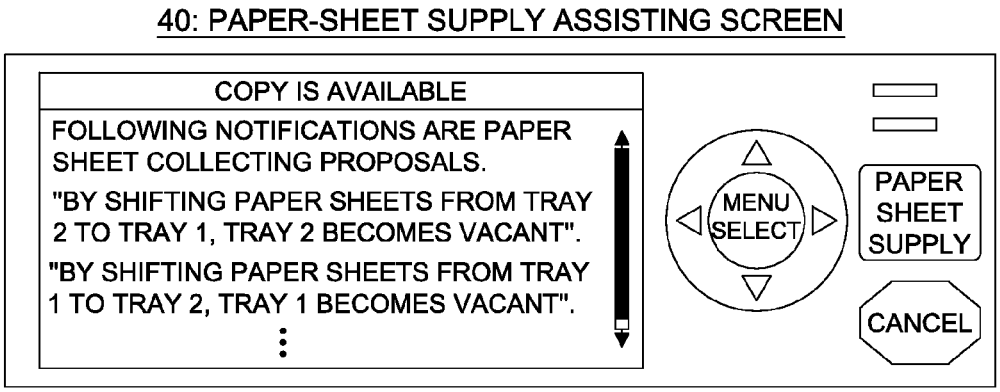
FIG. 7 shows a schematic diagram indicating an exemplary layout of a screen to be displayed on a display operating section of an image forming apparatus embodied in the present invention as EMBODIMENT 1.
Figure 8:
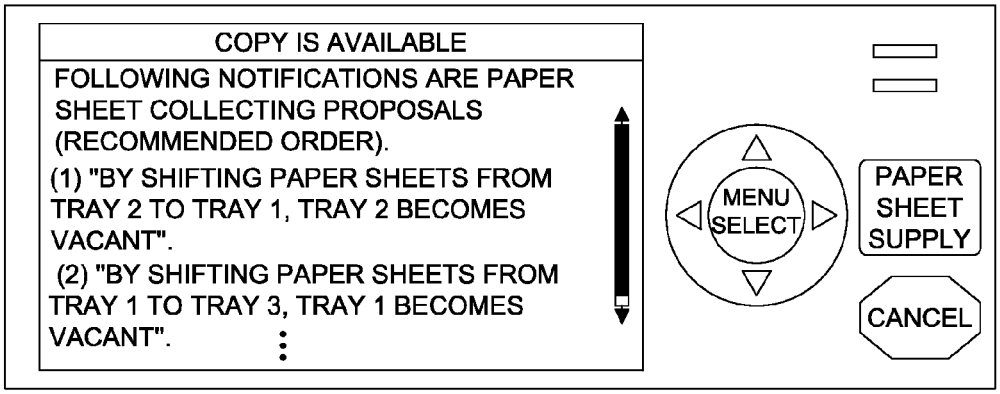
FIG. 8 shows a schematic diagram indicating another exemplary layout of a screen to be displayed on a display operating section of an image forming apparatus embodied in the present invention as EMBODIMENT 1.

In order to describe the preferred embodiment of the present invention in detail, referring to FIG. 1 through FIG. 8, an image forming apparatus and a method for assisting a paper sheet supplying operation and a control program, embodied in the present invention as EMBODIMENT 1, will be detailed in the following. FIG. 1 and FIG. 2 show schematic diagrams of a configuration of a printing system embodied in the present invention, while FIG. 3 shows a block diagram indicating a configuration of the image forming apparatus embodied in the present invention. Further, FIG. 4 shows a schematic diagram indicating a structure of a printing section provided in the image forming apparatus embodied in the present invention, while FIG. 5*a* shows a schematic diagram indicating an exemplary structure of a paper sheet supplying section of the image forming apparatus and FIG. 5*b* shows a schematic diagram indicating an exemplary structure of a capacity detecting section provided in the paper sheet tray. Still further, FIG. 6 shows a flowchart indicating operations to be conducted in the image forming apparatus embodied in the present invention. Yet further, FIG. 7 and FIG. 8 show exemplary layouts of screens to be displayed on a display operating section of the image forming apparatus.

As shown in FIG. 1, a printing system 10, embodied in the present invention, is constituted by a image forming apparatus 20, such as a printer, a Digital Multi-Function Peripheral, etc.

Further, as shown in FIG. 3, the image forming apparatus 20 is constituted by a control section 21 that includes a CPU (Central Processing Unit) 21*a*, a ROM (Read Only Memory) 21*b*, a RAM (Random Access Memory) 21*c*, etc., an HDD (Hard Disc Drive) 22, a display operating section 23, a paper sheet managing section 24, an image forming section 25, a printing section 26, a paper sheet supplying section 27, etc.

The ROM 21*b* stores programs for controlling the overall operations of the image forming apparatus as a whole and data being necessary for controlling operations (for instance, a maximum accommodating capacity of each of the paper sheet trays, etc.), therein. The RAM 21*c* stores data being necessary for controlling operations to be executed by the CPU 21*a* and other data to be temporarily stored during implementation of the controlling operations (for instance, a size, a kind, a direction, a residual amount, etc., of the paper sheets to be accommodated into each of the paper sheet trays), therein. Further, the CPU 21*a* works in conjunction with the ROM 21*b* and the RAM 21*c*, so as to serve as the control section 21 for controlling the overall operations of the image forming apparatus as a whole.

The HDD 22 stores a print job and data being necessary for the controlling operations to be conducted by the control section 21 (for instance, a size, a kind, a direction, a residual amount, etc., of the paper sheets to be accommodated into each of the paper sheet trays), therein.

The display operating section 23 is constituted by a display section, such as a LCD (Liquid Crystal Display), etc., and an operating section, such as a touch panel covering the display section, etc., so as to make it possible to display various kinds of screens, detailed later, thereon and to input attributes of paper sheets, detailed later, therefrom. In this connection, although the display section and the operating section are integrated into one body in the present embodiment, it is also applicable that the display section and the operating section are configured separately from each other.

Based on information outputted by the capacity detecting section provided in each of the paper sheet trays, detailed later, the paper sheet managing section 24 acquires a capacity of paper sheets remaining in each of the paper sheet trays (residual amount of paper sheets), specifies the paper sheets having the same attribute, calculates a total sum of the residual amounts of the paper sheets concerned, compares the calculated total sum of the residual amounts of the paper sheets with the maximum accommodating capacity of a paper sheet tray 28 currently accommodating the paper sheets concerned, and then, if there is such a case that the total sum of the residual amounts of the paper sheets concerned is equal to or smaller than the maximum accommodating capacity of the paper sheet tray 28, exists, notifies the operator of the fact that a vacant tray can be made by collecting the same attribute paper sheets residing in a plurality of paper sheet trays 28. It is applicable that the paper sheet managing section 24 is configured as hardware, or as a control program that makes the computer serve as the paper sheet managing section 24 and that is executed by the control section 21.

The image forming section 25 rasterizes data of each of the pages included in the print job, and applies an image processing and/or a screening operation to the rasterized data so as to create bitmap data based on which the printing section 26 can conduct a printing operation.

The printing section 26 utilizes an image forming process, such as an electro-photographic method, an electrostatic recording method, etc., so as to transfer an image, formed by the image forming section 25 based on the bitmap data, to the paper sheet. Concretely speaking, as shown in FIG. 4, the printing section 26 is constituted by: a plurality of photoreceptor drum units, each of which is provided with a photoreceptor drum, a developing device, an image writing unit (not shown in the drawings) to irradiate and expose a laser beam onto the photoreceptor drum based on the bitmap data inputted from the image forming section 25, a charging device, a photoreceptor drum cleaning section and a primary transferring roller, so as to form each of toner images of a unicolor Y (Yellow), a unicolor M (Magenta), a unicolor C (Cyan) and a unicolor K (Black); an intermediate transfer belt serving as an intermediate transfer member that conveys the toner images formed by the plurality of photoreceptor drum units onto the paper sheet; a belt cleaning section to clean a circumferential surface of the intermediate transfer belt; a secondary transferring roller to transfer the toner images formed on the intermediate transfer belt onto the paper sheet; a roller cleaning section to apply a voltage to the secondary transferring roller so as to conduct an operation for transferring the toner images onto the secondary transferring roller and an operation for cleaning the secondary transferring roller; a fixing device to fix the toner image transferred onto the paper sheet; a fixing device cleaning section to clean the fixing device; a conveyance section that includes a paper sheet pick-up roller (not shown in the drawings), a pair of registration rollers, a pair of loop rollers, a pair of inversion rollers, a pair of ejection rollers, etc., so as to pick up and convey a desired paper sheet from the paper sheet supplying section 27; etc.

As shown in FIG. 5*a*, the paper sheet supplying section 27 is constituted by a plurality of paper sheet trays 28, and as shown in FIG. 5*b*, a capacity detecting section 28*a* to physically detect a residual amount of paper sheets (for instance, a photosensitive type distance sensor) is disposed at an upper section of each of the paper sheet trays 28. The abovementioned distance sensor, serving as the capacity detecting section 28*a*, is provided with a light emitting section and a light receiving section, both of which are disposed at different positions having such a positional relationship that the light emitted by the light emitting section is reflected from the upper surface of the paper sheets accommodating in the paper sheet tray 28 concerned, and the reflected light returns to the light receiving section, so that the distance to the upper surface of the paper sheets can be calculated from the position of the light receiving element, provided in the light receiving section, to which the reflected light returns. In this connection, the scope of the capacity detecting section is not limited to the photosensitive type distance sensor abovementioned. Any one of a weight detecting sensor disposed at lower section of the paper sheet tray 28 to detect the capacity as a weight of paper sheets, a position detecting sensor arranged in a paper sheet stacking direction to detect a stacked amount of paper sheets, etc., is also applicable as the capacity detecting section 28*a*.

Further, in this connection, although the printing system 10 of the present embodiment shown in FIG. 1 is only constituted by the image forming apparatus 20, it is also applicable that, as shown in FIG. 2, the printing system 10 is constituted by a computer terminal device 30, such as a printer controller, a client terminal device, etc., and the image forming apparatus 20, both of which are coupled to each other through a communication network, such as a LAN (Local Area Network), a WAN (Wide Area Network), etc. In the above case, a network coupling section, such as a NIC (Network Interface Card), a modem, etc., should be additionally installed into the image forming apparatus 20, and the paper sheet managing section 24 may be installed into at least one of the image forming apparatus 20 and the computer terminal device 30 as either hardware or software.

Referring to the flowchart shown in FIG. 6, the method for assisting the paper sheet supplying operation employing the image forming apparatus 20 having the abovementioned configuration will be detailed in the following.

Initially, in Step S101, the user operates the display operating section 23 to input information (hereinafter, referred to as paper sheet attributes), such as a size of paper sheets to be accommodated into each of the paper sheet trays 28 (for instance, A4, B4, A3, etc.), a kind of paper sheets (for instance, a normal paper, a heavy paper, a glossy paper, etc.), a direction of paper sheet (for instance, a horizontal direction, a vertical direction), etc., and the control section 21 stores the inputted paper sheet attributes into the RAM 21*c*, the HDD 22, etc., while correlating them with the maximum accommodating capacity of each of the paper sheet trays 28, stored in advance.

In this connection, although the user inputs the paper sheet attributes in the abovementioned embodiment, Step S101 can be omitted when the paper sheet attributes are registered in advance. Further, when the computer terminal device 30 is coupled to the communication network, it is also applicable that the paper sheet attributes are established on the browsing software of the computer terminal device 30 by using the Web server function of the image forming apparatus 20, or the MIB (Management Information Base) information disclosed by the image forming apparatus 20 is established from the computer terminal device 30 through a network application program.

Successively, in Step S102, the capacity detecting section 28*a* (for instance, a distance sensor), disposed in each of the paper sheet trays 28, detects the residual amount of paper sheets currently stored in each of the paper sheet trays 28. Then, the control section 21 stores the residual amount of paper sheets detected by the capacity detecting section 28*a*, and the paper sheet attributes and the maximum accommodating capacity of each of the paper sheet trays 28 into the RAM 21*c*, the HDD 22, etc., while correlating them with each other.

In this connection, it is applicable that the residual amount of paper sheets can be indicated by either the thickness of paper sheets or the number of paper sheets. When the thickness of paper sheets is employed as indicator, the thickness can be calculated by subtracting a current distance at the time of stacking the paper sheets at present from another distance at the time of stacking no paper sheet. Further, when the number of paper sheets is employed as indicator, a symbol indicating a maximum stacking position is displayed within the paper sheet tray 28 in advance, so that, when the paper sheet supplying operator supplies the paper sheets up to that position, the operator inputs information of "COMPLETION OF PAPER SHEET SUPPLY" in regard to the paper sheet tray 28 concerned, by using the display operating section 23. With respect to the paper sheet tray 28 for which the above inputting operation is completed, it is deemed that the paper sheets have been supplied up to the maximum accommodating capacity, and after that, by subtracting the number of paper sheets actually used from the maximum accommodating capacity, it becomes possible to indicate the residual amount of paper sheets as the number of paper sheets. Table 1 shows an exemplary table including the paper sheet attributes, the maximum accommodating capacity (number of paper sheets) and the residual amount of paper sheets (number of paper sheets), for every paper sheet tray.

TABLE 1

| | Tray | | | | |
|---|---|---|---|---|---|
| | Tray 1 | Tray 2 | Tray 3 | Tray 4 | Tray 5 |
| Paper sheet attributes | A4 Normal paper H direction | A4 Normal paper H direction | A4 Normal paper H direction | A3 Normal paper V direction | A3 Normal paper V direction |
| Maximum capacity of tray | 250 paper sheets | 250 paper sheets | 500 paper sheets | 250 paper sheets | 500 paper sheets |
| Residual amount of paper sheet | 100 paper sheets | 150 paper sheets | 200 paper sheets | 250 paper sheets | 250 paper sheets |

H direction: Horizontal direction,
V direction: Vertical direction

Still successively, in Step S103, the paper sheet managing section 24 (control program) retrieves a combination of paper sheet trays 28 to accommodate the paper sheets having the same paper sheet attributes (size, kind and direction) by referring to the paper sheet attributes stored for every paper sheet tray. Table 2 shows an exemplary table including various kinds of retrieved combinations of paper sheet trays.

TABLE 2

| Combinations of Trays | Paper sheet attributes |
|---|---|
| T1 + T2 | Same (A4, Normal paper, H direction) |
| T1 + T3 | Same (A4, Normal paper, H direction) |
| T1 + T4 | Different |
| T1 + T5 | Different |
| T2 + T3 | Same (A4, Normal paper, H direction) |
| T2 + T4 | Different |
| T2 + T5 | Different |
| T3 + T4 | Different |
| T3 + T5 | Different |
| T4 + T5 | Same (A3, Normal paper, V direction) |
| T1 + T2 + T3 | Same (A4, Normal paper, H direction) |
| T1 + T2 + T4 | Different |
| T1 + T2 + T5 | Different |
| T1 + T3 + T4 | Different |
| T1 + T3 + T5 | Different |
| T1 + T4 + T5 | Different |
| T2 + T3 + T4 | Different |
| T2 + T3 + T5 | Different |
| T2 + T4 + T5 | Different |
| T3 + T4 + T5 | Different |
| T1 + T2 + T3 + T4 | Different |
| T1 + T2 + T3 + T5 | Different |
| T1 + T2 + T4 + T5 | Different |
| T1 + T3 + T4 + T5 | Different |
| T2 + T3 + T4 + T5 | Different |
| T1 + T2 + T3 + T4 + T5 | Different |

H direction: Horizontal direction,
V direction: Vertical direction
(T1 = Tray 1, T2 = Tray 2, T3 = Tray 3, T4 = Tray 4, T5 = Tray 5)

Still successively, in Step S104, the paper sheet managing section 24 (control program) determines whether or not a combination of the trays that accommodates the paper sheets having the same paper sheet attributes (size, kind and direction) exists, from the results retrieved in Step S103. When determining that such the combination of the trays does not exist, the paper sheet managing section 24 finalizes the processing (END).

When determining that the combination of the trays that fulfill the abovementioned condition exists, in Step S105, the paper sheet managing section 24 (control program) calculates the total sum of the residual amounts of paper sheets accommodated in the paper sheet trays 28 that fulfill the abovementioned condition. In the example shown in Table 2, the five combinations of the trays, including the combination of Tray 1 and Tray 2, the combination of Tray 1 and Tray 3, the combination of Tray 2 and Tray 3, the combination of Tray 4 and Tray 5, the combination of Tray 1, Tray 2 and Tray 3, fulfill the abovementioned condition. Table 3 shows an exemplary table indicating the total sums of the residual amount of paper sheets.

TABLE 3

| | Residual amount of paper sheets | | | |
|---|---|---|---|---|
| Combination | T1 | T2 | T3 | Total sum |
| T1 + T2 | 100 | 150 | | 250 |
| T1 + T3 | 100 | | 200 | 300 |
| T2 + T3 | | 150 | 200 | 350 |
| T1 + T2 + T3 | 100 | 150 | 200 | 450 |
| T4 + T5 | 250 | 250 | | 500 |

(T1 = Tray 1, T2 = Tray 2, T3 = Tray 3, T4 = Tray 4, T5 = Tray 5)

Still successively, in Step S106, the paper sheet managing section 24 (control program) compares the total sum of the residual amounts of paper sheets with the maximum accommodating capacity of the paper sheet tray 28 in which the paper sheets, being a current object for calculating the total sum, are accommodated. As for the example shown in FIG. 3, in the case of the combination of Tray 1 and Tray 2, the paper sheet managing section 24 compares the total sum of the residual amounts of paper sheets (250 sheets) with the maximum accommodating capacity of Tray 1 (250 sheets) and the maximum accommodating capacity of Tray 2 (250 sheets). Further, in the case of the combination of Tray 1 and Tray 3, the paper sheet managing section 24 compares the total sum of the residual amounts of paper sheets (300 sheets) with the maximum accommodating capacity of Tray 1 (250 sheets) and the maximum accommodating capacity of Tray 3 (500 sheets). Still further, in the case of the combination of Tray 2 and Tray 3, the paper sheet managing section 24 compares the total sum of the residual amounts of paper sheets (350 sheets) with the maximum accommodating capacity of Tray 2 (250 sheets) and the maximum accommodating capacity of Tray 3 (500 sheets). Still further, in the case of the combination of Tray 1, Tray 2 and Tray 3, the paper sheet managing section 24 compares the total sum of the residual amounts of paper sheets (450 sheets) with the maximum accommodating capacity of Tray 1 (250 sheets) the maximum accommodating capacity of Tray 2 (250 sheets) and the maximum accommodating capacity of Tray 3 (500 sheets). Yet further, in the case of the combination of Tray 4 and Tray 5, the paper sheet managing section 24 compares the total sum of the residual amounts of paper sheets (500 sheets) with the maximum accommodating capacity of Tray 4 (250 sheets) and the maximum accommodating capacity of Tray 5 (500 sheets).

Still successively, in Step S107, the paper sheet managing section 24 determines whether or not there exists such a case that the total sum of the residual amounts of paper sheets is equal to or smaller than the maximum accommodating capacity of corresponding one of the paper sheet trays 28 concerned. As for the example shown in FIG. 3, in the case of the combination of Tray 1 and Tray 2, the total sum of the residual amounts of paper sheets (250 sheets) becomes equal to or smaller than the maximum accommodating capacity of Tray 1 (250 sheets) or the maximum accommodating capacity of Tray 2 (250 sheets). Further, in the case of the combination of Tray 1 and Tray 3, the total sum of the residual amounts of paper sheets (300 sheets) becomes smaller than the maximum accommodating capacity of Tray 3 (500 sheets). Still further, in the case of the combination of Tray 2 and Tray 3, the total sum of the residual amounts of paper sheets (350 sheets) becomes equal to or smaller than the maximum accommodating capacity of Tray 3 (500 sheets). Still further, in the case of the combination of Tray 1, Tray 2 and Tray 3, the total sum of the residual amounts of paper sheets (450 sheets) becomes equal to or smaller than the maximum accommodating capacity of Tray 3 (500 sheets). Yet further, in the case of the combination of Tray 4 and Tray 5, the total sum of the residual amounts of paper sheets (500 sheets) becomes equal to or smaller than the maximum accommodating capacity of Tray (500 sheets). Table 4 shows the above-determined results.

TABLE 4

| | Tray maximum accommodating capacity of paper sheets | | | | |
|---|---|---|---|---|---|
| Combination | T1 250 sheets | T2 250 sheets | T3 500 sheets | T4 250 sheets | T5 500 sheets |
| T1 + T2 | Collectable (A) | Collectable (B) | | | |
| T1 + T3 | Not Collectable | | Collectable (C) | | |
| T2 + T3 | | Not Collectable | Collectable (D) | | |
| T1 + T2 + T3 | Not Collectable | Not Collectable | Collectable (E) | | |
| T4 + T5 | | | | Not Collectable | Collectable (F) |

(T1 = Tray 1, T2 = Tray 2, T3 = Tray 3, T4 = Tray 4, T5 = Tray 5)

Yet successively, if no combination that fulfills the abovementioned condition exists, the processing is finalized (END), while, if a combination that fulfills the abovementioned condition exists, in Step S108, the paper sheet managing section 24 (control program) creates such a paper sheet collecting proposal (recommendation) that indicates a method of how to make a vacant tray by sifting paper sheets currently accommodated in a specific tray to another specific tray, so as to display the paper sheet collecting proposal onto a screen as shown in FIG. 7. Table 5 shows various examples of the paper sheet collecting proposals.

TABLE 5

| | |
|---|---|
| Exemplary notification for recommendation A | "BY SHIFTING PAPER SHEETS FROM TRAY 2 TO TRAY 1, TRAY 2 BECOMES VACANT" |
| Exemplary notification for recommendation B | "BY SHIFTING PAPER SHEETS FROM TRAY 1 TO TRAY 2, TRAY 1 BECOMES VACANT" |
| Exemplary notification for recommendation C | "BY SHIFTING PAPER SHEETS FROM TRAY 1 TO TRAY 3, TRAY 1 BECOMES VACANT" |
| Exemplary notification for recommendation D | "BY SHIFTING PAPER SHEETS FROM TRAY 2 TO TRAY 3, TRAY 2 BECOMES VACANT" |
| Exemplary notification for recommendation E | "BY SHIFTING PAPER SHEETS FROM TRAY 1 AND TRAY 2 TO TRAY 3, TRAY 1 AND TRAY 2 BECOME VACANT" |
| Exemplary notification for recommendation F | "BY SHIFTING PAPER SHEETS FROM TRAY 4 TO TRAY 5, TRAY 4 BECOMES VACANT" |

On that occasion, if a lot of the paper sheet collecting proposals are displayed, the user would be confused with them and unable to make a quick decision as to what proposal should be taken for collecting the paper sheets. In order to avoid such the confusion, it is applicable that only a limited number of proposals selected from the paper sheet collecting proposals are displayed, or the paper sheet collecting proposals are prioritized according to a rule determined in advance. As an example for the former case, for instance, only such the collecting proposal that the paper sheets are collected into the paper sheet tray 28 having the greatest maximum accommodating capacity among the other paper sheet trays 28, can be notified. As an example for the latter case, for instance, since the smaller the number of paper sheets to be moved is, the easier the paper sheet collecting work becomes, the collecting proposals concerned can be prioritized in order of the number of paper sheets to be moved, the smallest fast. Further, since the smaller the number of trays into which the paper sheets are collected is, the easier the paper sheet collecting work becomes, the collecting proposals concerned can be prioritized in order of the number of trays, the smallest fast.

In this connection, each of the processing and the notifying operations abovementioned can be performed at arbitral timing. For instance, it is applicable that the system is so constituted that any one of the processing and the notifying operations abovementioned is performed at the time when the user opens the paper sheet tray 28 of the image forming apparatus 20, at the time when the intention to perform the paper sheet supplying operation is indicated from the image forming apparatus 20, or at the time when the predetermined notification time has arrived. Further, any one of arbitral methods can be employed as the notification method, and for instance, it is applicable that the abovementioned collecting proposals are displayed on the display operating section 23, the notification is performed by using an audible voice, or the abovementioned collecting proposals are displayed on the browsing software of the computer terminal device 30 by using the Web server function of the image forming apparatus 20. Still further, it is also applicable that, with respect to the apparatus that is accessible to the mail server and provided with the E-mail transmitting and receiving functions, the abovementioned collecting proposals are notified via E-mail. In that case, it is preferable that the address of the E-mail is set at any one of the system manager, the apparatus manager, etc.

As described in the foregoing, by conducting the consecutive operations including: specifying the paper sheets having the same attribute; calculating a total sum of the residual amounts of the paper sheets concerned; comparing the calculated total sum of the residual amounts of the paper sheets with the maximum accommodating capacity of the paper sheet tray currently accommodating the paper sheets concerned; and notifying the operator of a paper sheet collecting proposal that indicates a method of how to make a vacant tray by sifting paper sheets currently accommodated in a specific tray to another specific tray, if a combination, in which the total sum of the residual amounts of the paper sheets concerned is equal to or smaller than the maximum accommodating capacity of the paper sheet tray, exists, it becomes possible to accommodate the paper sheets in a unit of bunch or box into the vacant tray without leaving anything.

Embodiment 2

Figure 9:
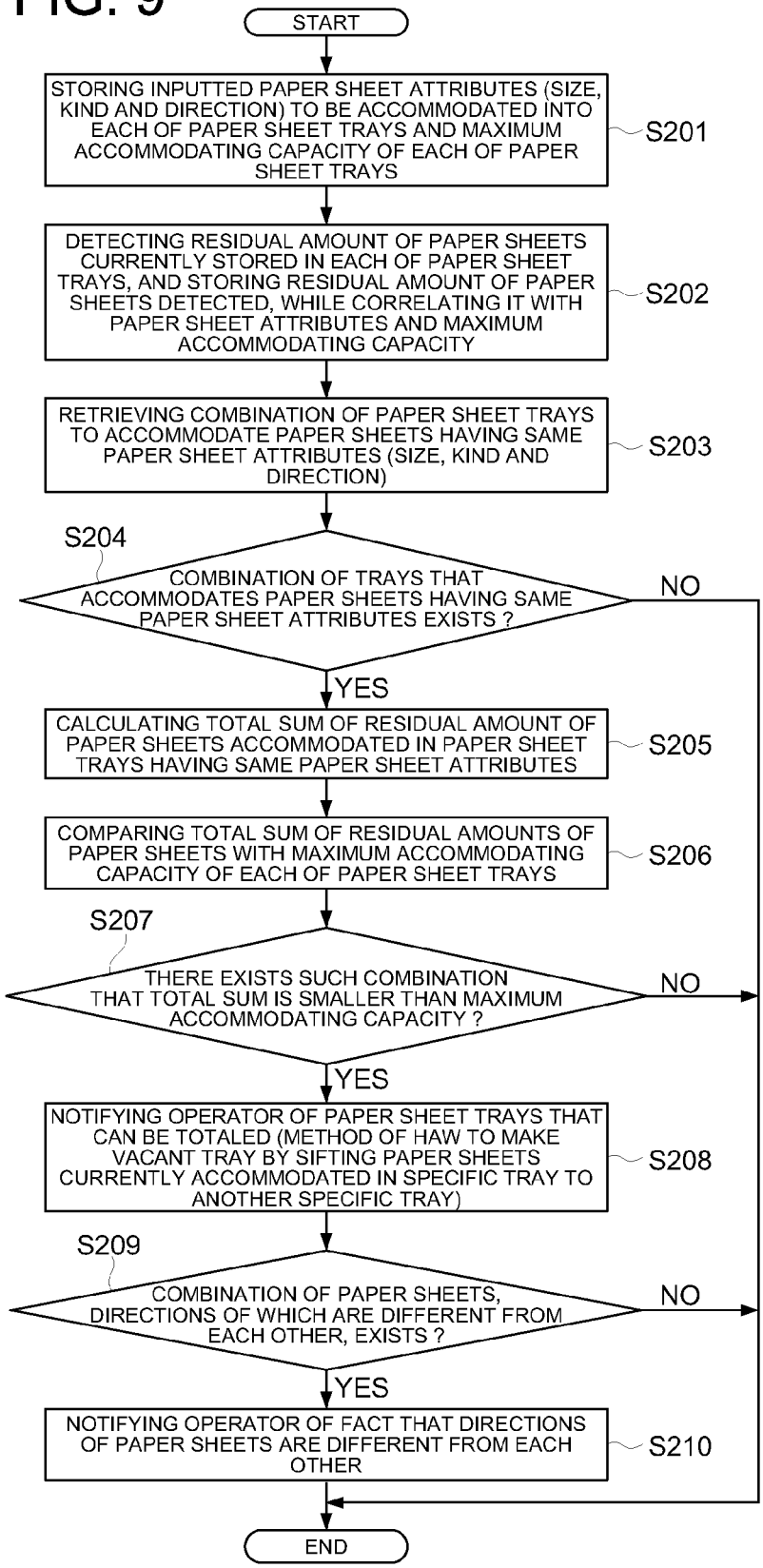
FIG. 9 shows a flowchart indicating a method for assisting paper sheet supplying operation to be conducted in an image forming apparatus embodied in the present invention as EMBODIMENT 2.
Figure 10:
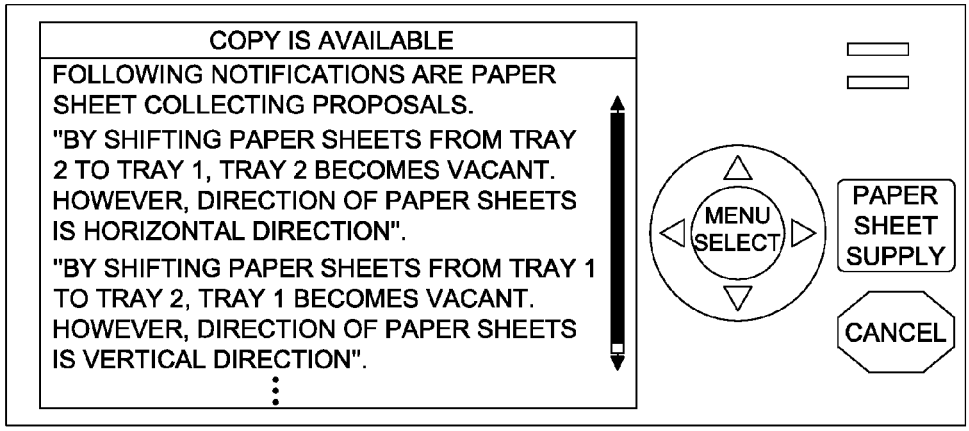
FIG. 10 shows a schematic diagram indicating an exemplary layout of a screen to be displayed on a display operating section of an image forming apparatus embodied in the present invention as EMBODIMENT 2.
Figure 11:
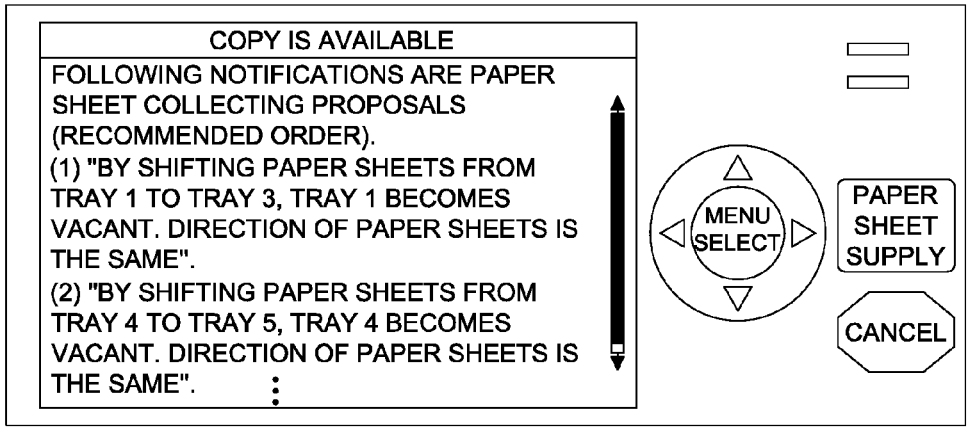
FIG. 11 shows a schematic diagram indicating another exemplary layout of a screen to be displayed on a display operating section of an image forming apparatus embodied in the present invention as EMBODIMENT 2.

Next, referring to FIG. 9 through FIG. 11, an image forming apparatus and a method for assisting a paper sheet supplying operation and a control program, embodied in the present invention as EMBODIMENT 2, will be detailed in the following. FIG. 9 shows a flowchart indicating operations to be conducted in the image forming apparatus embodied in the present invention. Further, FIG. 10 and FIG. 11 show exemplary layouts of screens to be displayed on a display operating section of the image forming apparatus.

In EMBODIMENT 1 aforementioned, the paper sheets, the sizes and the kinds of which are the same as each other as its attributes, are collected into the paper sheet tray 28 serving as a single paper sheet tray. However, even it directions of the paper sheets are different from each other, it is possible to collect them into the paper sheet tray 28 serving as a single paper sheet tray, by changing the directions of paper sheets. Referring to the flowchart shown in FIG. 9, the procedure for achieving the above will be detailed in the following.

Initially, in Step S201, as well as EMBODIMENT 1, the user operates the display operating section 23 to input the paper sheet attributes, such as a size of paper sheets to be accommodated into each of the paper sheet trays 28, a kind of paper sheets, a direction of paper sheet, etc., and the control section 21 stores the inputted paper sheet attributes into the RAM 21*c*, the HDD 22, etc., while correlating them with the maximum accommodating capacity of each of the paper sheet trays 28, stored in advance. In this connection, Step S201 can be omitted when the paper sheet attributes are registered in advance. Further, it is also applicable that the paper sheet attributes are established on the browsing software of the computer terminal device 30 by using the Web server function of the image forming apparatus 20, or the MIB (Management Information Base) information disclosed by the image forming apparatus 20 is established from the computer terminal device 30 through a network application program.

Successively, in Step S202, the capacity detecting section 28*a* (for instance, a distance sensor), disposed in each of the paper sheet trays 28, detects the residual amount of paper sheets currently stored in each of the paper sheet trays 28. Then, the control section 21 stores the residual amount of paper sheets detected by the capacity detecting section 28*a*, and the paper sheet attributes and the maximum accommodating capacity of each of the paper sheet trays 28 into the RAM 21*c*, the HDD 22, etc., while correlating them with each other. In this connection, it is applicable that the residual amount of paper sheets can be indicated by either the thickness of paper sheets or the number of paper sheets. Table 6 shows an exemplary table including the paper sheet attributes, the maximum accommodating capacity (number of paper sheets) and the residual amount of paper sheets (number of paper sheets), for every paper sheet tray.

TABLE 6

| | Tray | | | | |
|---|---|---|---|---|---|
| | Tray 1 | Tray 2 | Tray 3 | Tray 4 | Tray 5 |
| Paper sheet attributes | A4 Normal paper H direction | A4 Normal paper V direction | A4 Normal paper H direction | A3 Normal paper V direction | A3 Normal paper V direction |
| Maximum capacity of tray | 250 paper sheets | 250 paper sheets | 500 paper sheets | 250 paper sheets | 500 paper sheets |
| Residual amount of paper sheet | 100 paper sheets | 150 paper sheets | 200 paper sheets | 250 paper sheets | 250 paper sheets |

H direction: Horizontal direction,
V direction: Vertical direction

Still successively, in Step S203, the paper sheet managing section 24 (control program) retrieves a combination of paper sheet trays 28 to accommodate the paper sheets having the same size and being the same kind by referring to the paper sheet attributes stored for every paper sheet tray. In this connection, even if the directions of the paper sheets are different from each other, since it is possible to collect the paper sheets concerned by changing the directions of them, the directions of the paper sheets are not matter of consideration. Table 7 shows an exemplary table including various kinds of retrieved combinations of paper sheet trays.

TABLE 7

| Combinations of Trays | Paper sheet attributes |
|---|---|
| T1 + T2 | Same (A4, Normal paper) |
| T1 + T3 | Same (A4, Normal paper) |
| T1 + T4 | Different |
| T1 + T5 | Different |
| T2 + T3 | Same (A4, Normal paper) |
| T2 + T4 | Different |
| T2 + T5 | Different |
| T3 + T4 | Different |
| T3 + T5 | Different |
| T4 + T5 | Same (A3, Normal paper) |
| T1 + T2 + T3 | Same (A4, Normal paper) |
| T1 + T2 + T4 | Different |
| T1 + T2 + T5 | Different |
| T1 + T3 + T4 | Different |
| T1 + T3 + T5 | Different |
| T1 + T4 + T5 | Different |
| T2 + T3 + T4 | Different |
| T2 + T3 + T5 | Different |
| T2 + T4 + T5 | Different |

TABLE 7-continued

| Combinations of Trays | Paper sheet attributes |
|---|---|
| T3 + T4 + T5 | Different |
| T1 + T2 + T3 + T4 | Different |
| T1 + T2 + T3 + T5 | Different |
| T1 + T2 + T4 + T5 | Different |
| T1 + T3 + T4 + T5 | Different |
| T2 + T3 + T4 + T5 | Different |
| T1 + T2 + T3 + T4 + T5 | Different |

H direction: Horizontal direction,
V direction: Vertical direction
(T1 = Tray 1, T2 = Tray 2, T3 = Tray 3, T4 = Tray 4, T5 = Tray 5)

Still successively, in Step S204, the paper sheet managing section 24 (control program) determines whether or not a combination of the trays that accommodates the paper sheets having the same paper sheet attributes (size and kind) exists, from the results retrieved in Step S203. When determining that such the combination of the trays does not exist, the paper sheet managing section 24 finalizes the processing (END).

When determining that the combination of the trays that fulfill the abovementioned condition exists, in Step S205, the paper sheet managing section 24 (control program) calculates the total sum of the residual amounts of paper sheets accommodated in the paper sheet trays 28 that fulfill the abovementioned condition. Table 8 shows an exemplary table indicating the total sums of the residual amounts of paper sheets.

TABLE 8

| | Residual amount of paper sheets | | | |
|---|---|---|---|---|
| Combination | T1 | T2 | T3 | Total sum |
| T1 + T2 | 100 | 150 | | 250 |
| T1 + T3 | 100 | | 200 | 300 |
| T2 + T3 | | 150 | 200 | 350 |
| T1 + T2 + T3 | 100 | 150 | 200 | 450 |
| T4 + T5 | 250 | 250 | | 500 |

(T1 = Tray 1, T2 = Tray 2, T3 = Tray 3, T4 = Tray 4, T5 = Tray 5)

Still successively, in Step S206, the paper sheet managing section 24 (control program) compares the total sum of the residual amounts of paper sheets with the maximum accommodating capacity of the paper sheet tray 28 in which the paper sheets, being a current object for calculating the total sum, are accommodated. Then, in Step S207, the paper sheet managing section 24 determines whether or not there exists such a case that the total sum of the residual amounts of paper sheets is equal to or smaller than the maximum accommodating capacity of corresponding one of the paper sheet trays 28 concerned. Table 9 shows the above-determined results.

TABLE 9

| | Tray maximum accommodating capacity of paper sheets | | | | |
|---|---|---|---|---|---|
| Combination | T1 250 sheets | T2 250 sheets | T3 500 sheets | T4 250 sheets | T5 500 sheets |
| T1 + T2 | Collectable (A) | Collectable (B) | | | |
| T1 + T3 | Not Collectable | | Collectable (C) | | |
| T2 + T3 | | Not Collectable | Collectable (D) | | |
| T1 + T2 + T3 | Not Collectable | Not Collectable | Collectable (E) | | |
| T4 + T5 | | | | Not Collectable | Collectable (F) |

(T1 = Tray 1, T2 = Tray 2, T3 = Tray 3, T4 = Tray 4, T5 = Tray 5)

Still successively, if no combination that fulfills the abovementioned condition exists, the processing is finalized (END), while, if a combination that fulfills the abovementioned condition exists, in Step S208, the paper sheet managing section 24 (control program) creates such a paper sheet collecting proposal (recommendation) that indicates a method of how to make a vacant tray by sifting paper sheets currently accommodated in a specific tray to another specific tray, so as to display the paper sheet collecting proposal onto a screen of display operating section 23.

Still successively, in Step S209, referring to the paper sheet attributes stored in advance, the paper sheet managing section 24 (control program) determines whether or not a combination of paper sheets, directions of which are different from each other, exists among the combinations that are notified as the paper sheet collecting proposal. In EMBODIMENT 2, since A4 size normal paper sheets are accommodated in the Tray 1 in a horizontal direction, while other A4 size normal paper sheets are accommodated in the Tray 2 in a vertical direction, the direction of paper sheets in the paper sheet collecting proposal 1 is different from that in the paper sheet collecting proposal 2. Further, since A4 size normal paper sheets are accommodated in the Tray 2 in a vertical direction, while other A4 size normal paper sheets are accommodated in the Tray 4 in a horizontal direction, the directions of paper sheets are different from each other even in the paper sheet collecting proposal 4. Still further, since A4 size normal paper sheets are accommodated in the Tray 1 in a horizontal direction, other A4 size normal paper sheets are accommodated in the Tray 2 in a vertical direction, while still other A4 size normal paper sheets are accommodated in the Tray 3 in a horizontal direction, the directions of paper sheets are different from each other even in the paper sheet collecting proposal 5.

Yet successively, when determining that a combination of paper sheets, directions of which are different from each other, exists (Step S209; Yes), in Step S210, the paper sheet managing section 24 (control program) notify the operator of the fact that the directions of paper sheets are different from each other in the paper sheet collecting proposal concerned. Table 10 shows various examples of the paper sheet collecting proposals. FIG. 10 shows an exemplary layout of a paper-sheet supply assisting screen 40 to be displayed on the display operating section 23.

TABLE 10

| | |
|---|---|
| Exemplary notification for recommendation A | "BY SHIFTING PAPER SHEETS FROM TRAY 2 TO TRAY 1, TRAY 2 BECOMES VACANT. HOWEVER, DIRECTION OF PAPER SHEETS IS HORIZONTAL DIRECTION" |
| Exemplary notification for recommendation B | "BY SHIFTING PAPER SHEETS FROM TRAY 1 TO TRAY 2, TRAY 1 BECOMES VACANT. HOWEVER, DIRECTION OF PAPER SHEETS IS VERTICAL DIRECTION" |
| Exemplary notification for recommendation C | "BY SHIFTING PAPER SHEETS FROM TRAY 1 TO TRAY 3, TRAY 1 BECOMES VACANT. DIRECTION OF PAPER SHEETS IS THE SAME" |
| Exemplary notification for recommendation D | "BY SHIFTING PAPER SHEETS FROM TRAY 2 TO TRAY 3, TRAY 2 BECOMES VACANT. HOWEVER, DIRECTION OF PAPER SHEETS IS HORIZONTAL DIRECTION" |
| Exemplary notification for recommendation E | "BY SHIFTING PAPER SHEETS FROM TRAY 1 AND TRAY 2 TO TRAY 3, TRAY 1 AND TRAY 2 BECOME VACANT. HOWEVER, DIRECTION OF PAPER SHEETS IS HORIZONTAL DIRECTION" |
| Exemplary notification for recommendation F | "BY SHIFTING PAPER SHEETS FROM TRAY 4 TO TRAY 5, TRAY 4 BECOMES VACANT. DIRECTION OF PAPER SHEETS IS THE SAME" |

In this connection, even in EMBODIMENT 2, if lots of the paper sheet collecting proposals are displayed, the user would be confused with them and unable to make a quick decision as to what proposal should be taken for collecting the paper sheets. In order to avoid such the confusion, it is also applicable in EMBODIMENT 2 that only a limited number of proposals selected from the paper sheet collecting proposals are displayed, or the paper sheet collecting proposals are prioritized according to a rule determined in advance. As an example for the former case, for instance, only such the collecting proposal that the paper sheets are collected into the paper sheet tray 28 having the greatest maximum accommodating capacity among the other paper sheet trays 28, can be notified. While, as an example for the latter case, for instance, since the paper sheet collecting work becomes easier when the paper sheets are collected without changing the directions of them, the collecting proposal that includes no direction changing work (collecting proposal C or F in the case of EMBODIMENT 2) can be ranked at a higher priority level. Further, it is also possible to prioritize the collecting proposals concerned in order of the number of paper sheets to be moved, the smallest fast, or in order of the number of trays, the smallest fast.

In this connection, each of the processing and the notifying operations abovementioned can be performed at arbitral timing. For instance, it is applicable that the system is so constituted that any one of the processing and the notifying operations abovementioned is performed at the time when the user opens the paper sheet tray 28 of the image forming apparatus 20, at the time when the intention to perform the paper sheet supplying operation is indicated from the image forming apparatus 20, or at the time when the predetermined notification time has arrived. Further, any one of arbitral methods can be employed as the notification method, and for instance, it is applicable that the abovementioned collecting proposals are displayed on the display operating section 23, the notification is performed by using an audible voice, the abovementioned collecting proposals are displayed on the browsing software of the computer terminal device 30, or the abovementioned collecting proposals are notified via E-mail.

As described in the foregoing, by conducting the consecutive operations including: specifying the paper sheets having the same size and being the same; calculating a total sum of the residual amounts of the paper sheets concerned; comparing the calculated total sum of the residual amounts of the paper sheets with the maximum accommodating capacity of the paper sheet tray 28 currently accommodating the paper sheets concerned; and notifying the operator of a paper sheet collecting proposal that indicates a method of how to make a vacant tray by sifting paper sheets currently accommodated in a specific tray to another specific tray while leaving them as it is or changing the directions of them, if a combination, in which the total sum of the residual amounts of the paper sheets concerned is equal to or smaller than the maximum accommodating capacity of the paper sheet tray, exists, it becomes possible to accommodate the paper sheets in a unit of bunch or box into the vacant tray without leaving anything.

In this connection, in EMBODIMENT 1 and EMBODIMENT 2, both exemplified in the foregoing, the configurations, in which the paper sheets are shifted and moved between the plural paper sheet trays 28 provided in the single unit of the image forming apparatus 20, have been described. However, the scope of the present invention is not limited to the aforementioned EMBODIMENT 1 and EMBODIMENT 2. The present invention is also applicable for such a case that the paper sheets are shifted and moved between plural paper sheet trays 28 provided in a plurality of image forming apparatuses 20, which are coupled to each other through a communication network, so as to configure a system configuration including the plurality of image forming apparatuses 20. In such the system configuration, the paper sheet managing section may be provided in any one of the plural image forming apparatuses 20 or the computer terminal device 30, as either hardware or software.

The present invention is available for an image forming apparatus that is provided with a plurality of paper sheet trays, a method for assisting an operation for supplying paper sheets in a desired unit in the image forming apparatus concerned and a control program for determining whether or not the paper sheets can be supplied in the desired unit.

According to the image forming apparatus, the method for assisting a paper sheet supplying operation and the control program, each of which is embodied in the present invention, it becomes possible to promote the operation for creating a vacant tray.

This is because, the paper sheet managing section (control program) provided in the image forming apparatus conducts the consecutive controlling operations including: specifying the paper sheets having the same attribute; calculating a total sum of the residual amounts of the paper sheets concerned; comparing the calculated total sum of the residual amounts of the paper sheets with the maximum accommodating capacity of a paper sheet tray currently accommodating the paper sheets concerned; and then, if there is such a combination of paper sheet trays that the total sum of the residual amounts of the paper sheets concerned is equal to or smaller than the maximum accommodating capacity of the paper sheet tray, notifying the operator of the method of how to make a vacant tray by collecting the paper sheets, having the same attributes and currently randomly dispersed over plural paper sheet trays, into a specific tray. Further, when a single or plural bunches of paper sheets can be accommodated into the vacant tray, it becomes possible to supply the paper sheets in a unit of a single or plural bunches of paper sheets.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

a plurality of paper sheet trays, each of the paper sheet trays accommodating a plurality of paper sheets therein, a formed image being transferred to each of the paper sheets;

a plurality of detecting sections, each of which is provided in each of the paper sheet trays, for detecting a residual amount of the paper sheets accommodated in each of the paper sheet trays; and a paper sheet managing section for conducting consecutive operations including:

acquiring the residual amount of the paper sheets accommodated in each of the paper sheet trays from each of the detecting sections;

calculating a total sum of the residual amounts of paper sheets having same attributes;

comparing the total sum of the residual amounts of the paper sheets having the same attributes with a maximum accommodating capacity of each of the paper sheet trays currently accommodating the paper sheets having the same attributes; and notifying an operator that a vacant tray can be made by collecting the residual amounts of the paper sheets having the same attributes into a specific paper sheet tray when a combination of the paper sheet trays currently accommodating the residual amounts of the paper sheets having the same attributes makes the total sum of the residual amounts of the paper sheets equal to or smaller than a maximum accommodating capacity of the specific paper sheet tray.

2. The image forming apparatus of claim 1, wherein the paper sheet managing section calculates the total sum of residual amounts of paper sheets, which are same in size, kind and direction; and wherein the paper sheet managing section compares the total sum of the residual amounts of the paper sheets with the maximum accommodating capacity of each of paper sheet trays included in a group currently accommodating the paper sheets; and wherein, if there exists such paper sheets and a combination of paper sheet trays that make the total sum of the residual amounts of the paper sheets equal to or smaller than the maximum accommodating capacity of a predetermined paper sheet tray included in the group, the paper sheet managing section notifies the operator of a fact that, by collecting the paper sheets into the predetermined paper sheet tray, other paper sheet trays included in the group become empty.

3. The image forming apparatus of claim 2, wherein, when there exist plural combinations of paper sheet trays, each of which makes the total sum of the residual amounts of the paper sheets equal to or smaller than the maximum accommodating capacity, the paper sheet managing section notifies the operator of a combination of paper sheet trays for collecting the paper sheets into a paper sheet tray whose maximum accommodating capacity is a greatest, a combination of paper sheet trays for shifting the paper sheets whose residual amount is smallest into the predetermined paper sheet tray, or a combination of paper sheet trays for making a number of paper sheet trays included in the group smallest, in preference to other combinations of paper sheet trays included in the plural combinations of paper sheet trays.

4. The image forming apparatus of claim 1, wherein the paper sheet managing section calculates the total sum of residual amounts of paper sheets, which are same in size and kind; and wherein the paper sheet managing section compares the total sum of the residual amounts of the paper sheets with the maximum accommodating capacity of each of paper sheet trays included in a group currently accommodating the paper sheets; and wherein, if there exists such paper sheets and a combination of paper sheet trays that make the total sum of the residual amounts of the paper sheets equal to or smaller than the maximum accommodating capacity of a predetermined paper sheet tray included in the group, the paper sheet managing section discriminates a direction of paper sheets accommodated in each of the paper sheet trays included in the group, and when directions of paper sheets are different from each other, notifies the operator of a fact that, by collecting the paper sheets into the predetermined paper sheet tray while adjusting the directions of paper sheets at a same direction, other paper sheet trays included in the group become empty.

5. The image forming apparatus of claim 4, wherein, when there exist plural combinations of paper sheet trays, each of which makes the total sum of the residual amounts of the paper sheets equal to or smaller than the maximum accommodating capacity, the paper sheet managing section notifies the operator of a combination of paper sheet trays for collecting the paper sheets into a paper sheet tray whose maximum accommodating capacity is a greatest, a combination of paper sheet trays for shifting the paper sheets whose residual amount is smallest into the predetermined paper sheet tray, or a combination of paper sheet trays for making a number of paper sheet trays included in the group smallest, in preference to other combinations of paper sheet trays included in the plural combinations of paper sheet trays.

6. A method for assisting a paper sheet supplying operation, which is to be employed in an image forming apparatus that includes a plurality of paper sheet trays, each of the paper sheet trays accommodating a plurality of paper sheets therein, a formed image being transferred to each of the paper sheets, and a plurality of detecting sections, each of which is provided in each of the paper sheet trays, for detecting a residual amount of the paper sheets accommodated in each of the paper sheet trays, the method comprising:

storing attributes of the paper sheets accommodated in each of the paper sheet trays;

acquiring the residual amount of the paper sheets accommodated in each of the paper sheet trays from each of the detecting sections;

calculating a total sum of the residual amounts of paper sheets having same attributes;

comparing the total sum of the residual amounts of the paper sheets having the same attributes with a maximum accommodating capacity of each of the paper sheet trays currently accommodating the paper sheets having the same attributes; and notifying an operator that a vacant tray can be made by collecting the residual amounts of the paper sheets having the same attributes into a specific paper sheet tray when a combination of the paper sheet trays currently accommodating the residual amounts of the paper sheets having the same attributes makes the total sum of the residual amounts of the paper sheets equal to or smaller than a maximum accommodating capacity of the specific paper sheet tray.

7. The method of claim 6, wherein, in the calculating step, the total sum of residual amounts of paper sheets, which are same in size, kind and direction, is calculated; and wherein, in the comparing step, the total sum of the residual amounts of the paper sheets is compared with the maximum accommodating capacity of each of paper sheet trays included in a group currently accommodating the paper sheets; and wherein, in the notifying step, if there exists such paper sheets and a combination of paper sheet trays that make the total sum of the residual amounts of the paper sheets equal to or smaller than the maximum accommodating capacity of a predetermined paper sheet tray included in the group, the operator is notified of a fact that, by collecting the paper sheets into the predetermined paper sheet tray, other paper sheet trays included in the group become empty.

8. The method of claim 7, wherein, when there exist plural combinations of paper sheet trays, each of which makes the total sum of the residual amounts of the paper sheets equal to or smaller than the maximum accommodating capacity, the operator is notified of a combination of paper sheet trays for collecting the paper sheets into a paper sheet tray whose maximum accommodating capacity is a greatest, a combination of paper sheet trays for shifting the paper sheets whose residual amount is smallest into the predetermined paper sheet tray, or a combination of paper sheet trays for making a number of paper sheet trays included in the group smallest, in preference to other combinations of paper sheet trays included in the plural combinations of paper sheet trays.

9. The method of claim 6, wherein, in the calculating step, the total sum of residual amounts of paper sheets, which are same in size, kind and direction, is calculated; and wherein, in the comparing step, the total sum of the residual amounts of the paper sheets is compared with the maximum accommodating capacity of each of paper sheet trays included in a group currently accommodating the paper sheets; and wherein, in the notifying step, if there exists such paper sheets and a combination of paper sheet trays that make the total sum of the residual amounts of the paper sheets equal to or smaller than the maximum accommodating capacity of a predetermined paper sheet tray included in the group, a direction of paper sheets accommodated in each of the paper sheet trays included in the group is discriminated, and when directions of paper sheets are different from each other, the operator is notified of a fact that, by collecting the paper sheets into the predetermined paper sheet tray while adjusting the directions of paper sheets at a same direction, other paper sheet trays included in the group become empty.

10. The method of claim 9, wherein, when there exist plural combinations of paper sheet trays, each of which makes the total sum of the residual amounts of the paper sheets equal to or smaller than the maximum accommodating capacity, the operator is notified of a combination of paper sheet trays for collecting the paper sheets into a paper sheet tray whose maximum accommodating capacity is a greatest, a combination of paper sheet trays for shifting the paper sheets whose residual amount is smallest into the predetermined paper sheet tray, or a combination of paper sheet trays for making a number of paper sheet trays included in the group smallest, in preference to other combinations of paper sheet trays included in the plural combinations of paper sheet trays.

11. A computer readable storage medium storing a computer executable program for assisting a paper sheet supplying operation to be implemented in an image forming apparatus, which includes: a plurality of paper sheet trays, each of the paper sheet trays accommodating a plurality of paper sheets therein, a formed image being transferred to each of the paper sheets; and a plurality of detecting sections, each of which is provided in each of the paper sheet trays, for detecting a residual amount of the paper sheets accommodated in each of the paper sheet trays, the program being executable by a computer to cause the computer to perform a process comprising:

acquiring the residual amount of the paper sheets accommodated in each of the paper sheet trays from each of the detecting sections;

calculating a total sum of the residual amounts of paper sheets having same attributes;

comparing the total sum of the residual amounts of the paper sheets having the same attributes with a maximum accommodating capacity of each of the paper sheet trays currently accommodating the paper sheets having the same attributes; and notifying an operator that a vacant tray can be made by collecting the residual amounts of the paper sheets having the same attributes into a specific paper sheet tray when a combination of the paper sheet trays currently accommodating the residual amounts of the paper sheets having the same attributes makes the total sum of the residual amounts of the paper sheets equal to or smaller than a maximum accommodating capacity of the specific paper sheet tray.

12. The computer readable storage medium of claim 11, wherein, in the calculating step, the total sum of residual amounts of paper sheets, which are same in size, kind and direction, is calculated; and wherein, in the comparing step, the total sum of the residual amounts of the paper sheets is compared with the maximum accommodating capacity of each of paper sheet trays included in a group currently accommodating the paper sheets; and wherein, in the notifying step, if there exists such paper sheets and a combination of paper sheet trays that make the total sum of the residual amounts of the paper sheets equal to or smaller than the maximum accommodating capacity of a predetermined paper sheet tray included in the group, the operator is notified of a fact that, by collecting the paper sheets into the predetermined paper sheet tray, other paper sheet trays included in the group become empty.

13. The computer readable storage medium of claim 12, wherein, when there exist plural combinations of paper sheet trays, each of which makes the total sum of the residual amounts of the paper sheets equal to or smaller than the maximum accommodating capacity, the operator is notified of a combination of paper sheet trays for collecting the paper sheets into a paper sheet tray whose maximum accommodating capacity is a greatest, a combination of paper sheet trays for shifting the paper sheets whose residual amount is smallest into the predetermined paper sheet tray, or a combination of paper sheet trays for making a number of paper sheet trays included in the group smallest, in preference to other combinations of paper sheet trays included in the plural combinations of paper sheet trays.

14. The computer readable storage medium of claim 11, wherein, in the calculating step, the total sum of residual amounts of paper sheets, which are same in size, kind and direction, is calculated; and wherein, in the comparing step, the total sum of the residual amounts of the paper sheets is compared with the maximum accommodating capacity of each of paper sheet trays included in a group currently accommodating the paper sheets; and wherein, in the notifying step, if there exists such paper sheets and a combination of paper sheet trays that make the total sum of the residual amounts of the paper sheets equal to or smaller than the maximum accommodating capacity of a predetermined paper sheet tray included in the group, a direction of paper sheets accommodated in each of the paper sheet trays included in the group is discriminated, and when directions of paper sheets are different from each other, the operator is notified of a fact that, by collecting the paper sheets into the predetermined paper sheet tray while adjusting the directions of paper sheets at a same direction, other paper sheet trays included in the group become empty.

15. The method of claim 14, wherein, when there exist plural combinations of paper sheet trays, each of which makes the total sum of the residual amounts of the paper sheets equal to or smaller than the maximum accommodating capacity, the operator is notified of a combination of paper sheet trays for collecting the paper sheets into a paper sheet tray whose maximum accommodating capacity is a greatest, a combination of paper sheet trays for shifting the paper sheets whose residual amount is smallest into the predetermined paper sheet tray, or a combination of paper sheet trays for making a number of paper sheet trays included in the group smallest, in preference to other combinations of paper sheet trays included in the plural combinations of paper sheet trays.

* * * * *